US005439126A

United States Patent [19]

Brownbill

[11] Patent Number: 5,439,126

[45] Date of Patent: Aug. 8, 1995

[54] ONE-PIECE PLASTICS

[75] Inventor: Thomas D. Brownbill, Devon, England

[73] Assignee: CarnaudMetalBox plc, United Kingdom

[21] Appl. No.: 387,381

[22] Filed: Feb. 13, 1995

Related U.S. Application Data

[63] Continuation of Ser. No. 123,246, Sep. 20, 1993, abandoned.

[51] Int. Cl.[6] ..... B65D 53/00

[52] U.S. Cl. ..... 215/344; 215/343; 215/341

[58] Field of Search ..... 215/341, 343, 345, 344, 215/DIG. 1

[56] References Cited

U.S. PATENT DOCUMENTS

| | | | |
|---|---|---|---|
| 3,160,303 | 12/1964 | Healy | 215/344 |
| 3,203,571 | 8/1965 | Plunkett | 215/344 |
| 3,255,907 | 6/1966 | Eddy | 215/344 |
| 3,814,274 | 6/1974 | McIntosh | 215/344 |
| 3,948,405 | 4/1976 | Yonker | 215/344 |
| 4,398,645 | 8/1983 | Toeppen | 215/344 |
| 4,415,095 | 11/1983 | Schweigert et al. | 215/344 |
| 4,450,973 | 5/1984 | Toeppen | 215/344 |
| 4,526,284 | 7/1985 | Herbert | 215/344 |
| 4,540,102 | 9/1985 | Wiedmer | 215/341 |
| 4,623,070 | 11/1986 | Nishikawa | 215/344 |
| 4,770,309 | 9/1988 | Thompson . | |
| 4,971,213 | 11/1990 | Ishinabe et al. | 215/344 |

FOREIGN PATENT DOCUMENTS

| | | |
|---|---|---|
| 0293901 | 8/1984 | European Pat. Off. . |
| 0460813 | 5/1991 | European Pat. Off. . |
| 7617929 | 6/1976 | France . |
| 1303436 | 12/1970 | United Kingdom . |
| 1539022 | 6/1976 | United Kingdom . |
| 2029808 | 12/1978 | United Kingdom . |
| 2021530 | 4/1979 | United Kingdom . |

*Primary Examiner*—David T. Fidei
*Attorney, Agent, or Firm*—Diller, Ramik & Wight

[57] ABSTRACT

A one-piece plastics closure for a carbonated beverage bottle has a sealing ring which extends inwardly and downardly towards the closure mouth from its attachment to the closure body. When the closure is fitted the ring extends around the outer radius and over the annular top face of the bottle neck, backed by a stepless abutment and reaction surface of the closure body. The latter surface engages the sealing ring mechanically above the container top face to determine the fitted position of the closure and create a seal when the pressure in the bottle is low. When the product pressure is high, however, the effective seal is made between the sealing ring and the outer radius of the bottle neck. For that purpose the abutment and reaction surface is roughened, so allowing access for the product pressure to the back of the sealing ring.

17 Claims, 3 Drawing Sheets

ONE-PIECE PLASTICS

This application is a continuation of application Ser. No. 08/123,246, filed Sep. 20, 1993, now abandoned.

BACKGROUND OF THE INVENTION

This invention relates to one-piece plastics closures for containers, that is to say, to container closures which have been moulded from polymeric material so as to incorporate a formation adapted for sealing engagement with a container to which the closure is fitted. This is to be contrasted with closures having a sealing wad, gasket or other feature which as a post-operation is fitted or formed in the closure after the latter has been moulded; closures of the latter kind are often referred to as "two-piece", even though the two components, i.e. the plastics moulding and the sealing feature, may be intimately joined together.

As is manifest from the many proposals for one-piece plastics closures which exist in the patent literature, it has long been realised that one-piece closures can provide considerable cost benefits over their two-piece counterparts. Only one moulding operation and the associated equipment is needed; moreover, there is no requirement to assemble components together or to position them in relation to one another for assembly.

Carbonated beverages are generally considered to represent one of the most onerous possible applications of plastics closures. The retention of high container pressures over long periods of time is difficult to achieve, and the difficulty is made greater by variations in the conditions to which the container may be subjected during transport and in storage; top-loading pressures and temperatures are two parameters to which the sealing efficiency of one-piece plastics closures may be particularly sensitive.

GB Patent specification No. 1539022 was proposed by the inventor of the present application for a container of a pressurised product. It has a flexible sealing formation which projects generally radially inwardly of the closure towards its free edge, and in the fitted position of the closure it is mechanically urged firmly and downwardly against the rim of the container neck by abutment of its upper surface by the generally annular bottom surface of a projecting support ring which is moulded to project from the underside of the generally plane closure panel or crown of the closure body.

In Patent specification No. 1539022, the pressure of the product in the container is allowed to act upon the sealing formation so as by pneumatically forcing it against the container rim to enhance the seal achieved. For that purpose the support ring is segmented, the spaces between the segments allowing the gas in the container headspace access to the top of the sealing formation. Outside the support ring (but above the container rim), the closure body is relieved from engagement with the sealing formation, so forming an annular chamber to which the product pressure is communicated. The support ring and the relieved surface of the closure body accordingly together form what may be regarded as a mechanical abutment and pneumatic reaction surface, for cooperation with the sealing formation. The support ring provides the abutment function of this surface; the relieved surface provides the reaction function of the surface, and is operative radially outside the support ring.

As previously indicated, one of the parameters of a carbonated beverage container to which many of the one-piece plastics closures proposed hitherto have been particularly sensitive is the top loading which may be applied to the container during transit and display, for example by other such containers placed on top of it. Because its seal interface with the container neck is perpendicular to the applied forces, the closure described in Patent specification 1539022 has been found in practice to be sensitive to top loading, and Applicants believe that it is incapable of meeting the present top-loading requirements of major carbonated beverage manufacturers.

In the closure illustrated in Patent Specification No. 1539022, the sealing formation is shown to extend for a considerable distance inwardly across the container rim, and moreover its attachment to the container body is located above the container rim radially within the outer periphery of the latter. Because of these spatial relationships little or no radially directed movement of the sealing ring across the container rim is required to occur as the closure is being fitted, and there will be correspondingly little danger that the sealing formation will be buckled or otherwise irregularly distorted by the support ring. Therefore, whilst sealing efficiency is assured in the absence of top loading, the closure of patent specification No. 1539022 is highly reliant upon sealing generally transversely to the axis of the closure; it accordingly has a substantial sensitivity to top loading as previously mentioned.

In Patent specification No. 1539022 the closure is arranged to be an interference fit (at its surface 41) with the outer surface of the container rim, but sealing at this locality cannot be relied upon because of the substantial variations which may exist in the relative dimensions of the container and the closure, especially if the container is made of glass and under elevated temperature conditions.

SUMMARY OF THE INVENTION

The present invention seeks to remove or reduce the shortcomings recited above of the closure described in Patent specification No. 1539022, and accordingly provides a one-piece closure for a pressurised product container having a mouth-defining rim with an arcuate outer periphery, the closure comprising a body having a generally plane closure panel and a depending tubular skirt and providing a mechanical abutment and pneumatic reaction surface within its interior, and a flexible sealing formation attached integrally to the body and extending inwardly of the closure to a free edge, the closure being arranged, when fitted to the container, for its sealing formation to seal against the container rim and to be urged against the same by mechanical and pneumatic cooperation with the abutment and reaction surface, seal-prevention means being provided for preventing the abutment and reaction surface from forming a seal with the sealing formation, characterised in that the abutment and reaction surface extends substantially steplessly so as in the fitted closure to lie in opposition to the container rim including the arcuate outer periphery thereof.

The above and other aspects and preferred features of the present invention will now become apparent from the following description of an embodiment thereof which is now to be given, by way of example only, with reference to the accompanying drawings. In the drawings;

DESCRIPTION OF THE PREFERRED EMBODIMENTS

Figure 1:
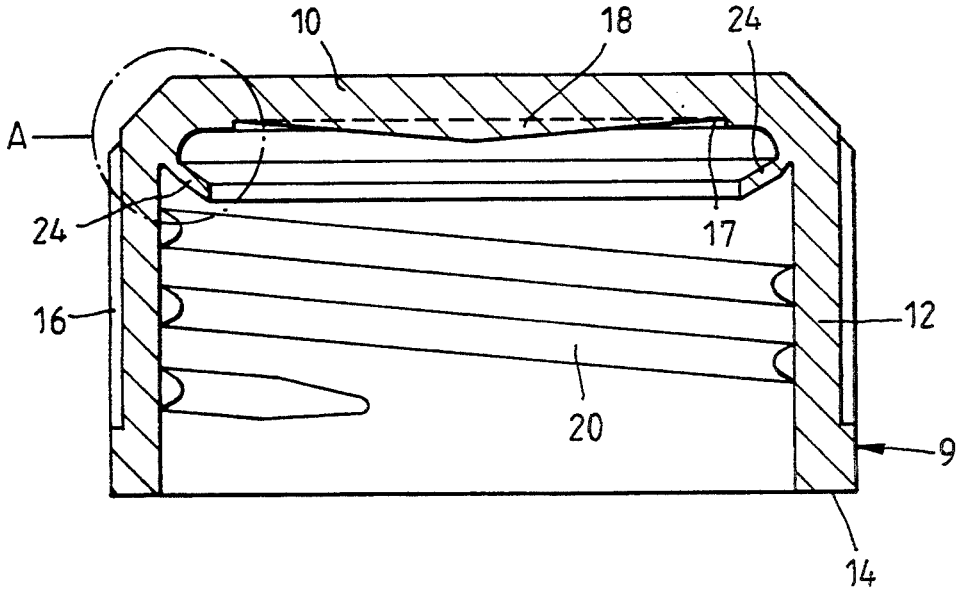
FIG. 1 is a slightly simplified view of a one-piece plastics closure for a carbonated beverage bottle, as seen in section taken on a diametral plane of the closure.

Referring firstly to FIG. 1 of the drawings, a one-piece screw closure for closing the neck of a beer or other carbonated beverage bottle is injection-moulded from high density polyethylene or other suitable thermoplastics polymeric material. It conventionally has a hollow body 9 formed of a generally plane closure panel or crown 10 arranged to overlie the rim of the bottle neck, and a generally cylindrical skirt 12 which extends from the periphery of the closure panel to its own free edge 14. It is to be understood that, if desired, the closure may have a tamper-indicating security ring integrally attached along a line of weakening corresponding in position to the edge 14.

The exterior of the skirt 12 is formed with axially extending, parallel knurls 16 to assist gripping by the user, and the closure panel 10 is reinforced against excessive deformation by carbonation pressure by means of three diagonally extending, crossed ribs, which are moulded on the underside of the closure panel at a shallow central recess 17 which is formed on the underside of the closure panel. The ribs form opposed arms which radiate at 60° intervals from the centre of the closure within the closure interior; one of the ribs is shown in FIG. 1 in longitudinal section and denoted by the reference numeral 18. A further feature of the closure is a helical screw thread 20 which is formed on the interior of the skirt 12 for engagement with a complementary thread formation 13 (FIG. 2) of the bottle neck to attach the closure to the bottle in well known manner. Axially extending vent slots are formed in the screw thread to prevent the risk of "missiling" when the closure is unscrewed; however, such vent slots are conventional, and they are omitted from the drawings for clarity.

Figure 2:
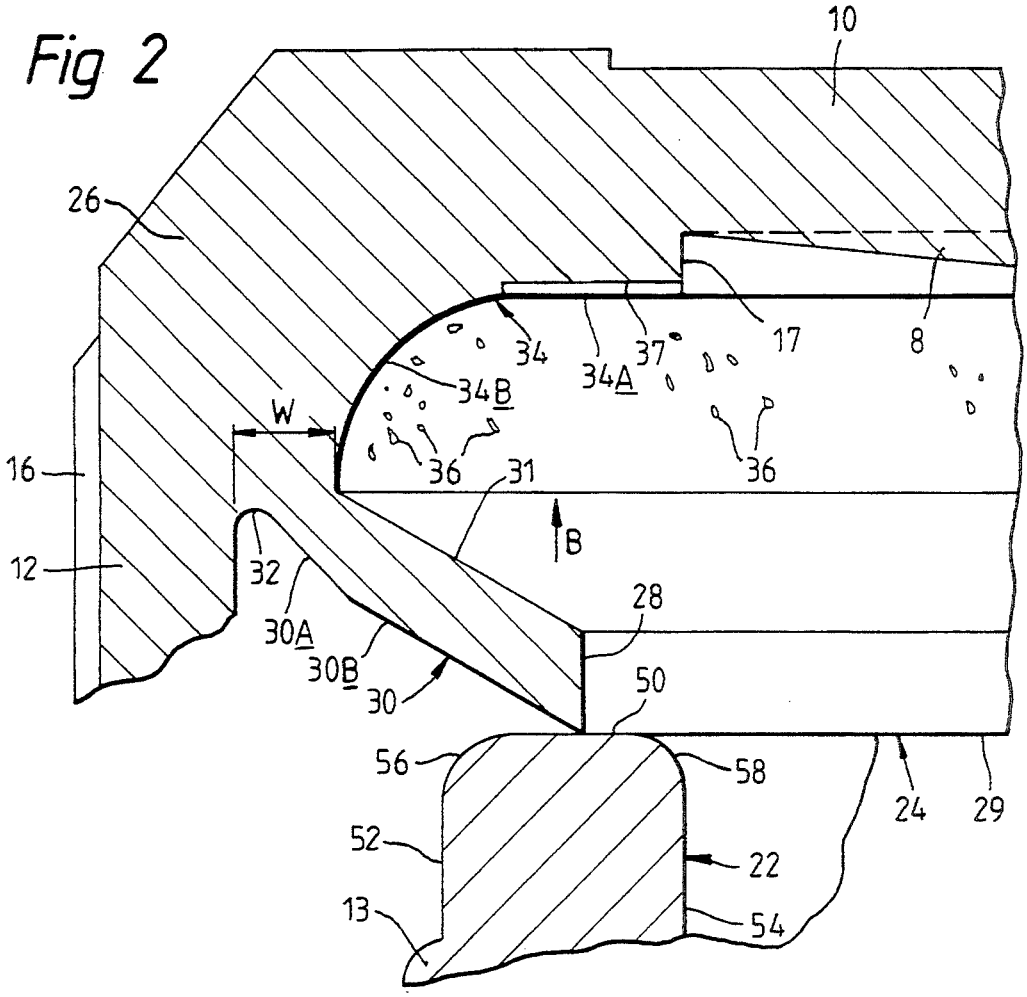
FIG. 2 is an enlarged view of the part of the closure ringed in FIG. 1 and as seen in association with the neck of a bottle to which the closure is being fitted.

FIG. 2 is an enlarged view showing in detail the part of the closure which is enclosed by circle A in FIG. 1, as it appears when the closure is being fitted to a bottle neck 22. The bottle neck has a plane, annular top face 50, a cylindrical outer side face 52 above the screw thread 13, a cylindrical inner bore 54, and arcuate outer and inner peripheral surfaces 56, 58 joining the surfaces 50, 52 and 50, 54 together. Each of the surfaces 56, 58 is substantially part-circular and of 90° subtended angle, the radius of the outer surface 56 being the greater.

A sealing formation 24 in the form of a peripherally continuous ring extends inwardly of the closure from integral connection to the closure body 9 at the bottom of a generally arcuate junction 26 of the skirt 12 and the closure panel 10. FIGS. 1 and 2 both show the sealing formation in its relaxed position, and from FIG. 2 in particular it will be seen that the sealing ring extends downwardly and inwardly of the closure towards its own free edge 28, the angle which it makes with the horizontal, that is to say, to a transverse plane through the closure, being 30°. The free edge 28 is cylindrical, so as to be directed axially of the closure, with the result that a compliant "feather edge" having a bottom edge or tip 29 is formed at the end of the sealing ring.

In the moulding of the closure the sealing ring is "jumped-out" of the mould for ejection, and to assist this operation it is rooted on the inner periphery of what can best be regarded as a transverse shoulder or step where the thickness of the closure wall abruptly increases at the top end of the skirt 12. This notional shoulder faces axially along the closure and has a width W which is sufficient to accommodate the thickness of the sealing ring during ejection. In order to provide it with increased flexibility in that locality the sealing ring is thinned adjacent its root by means of a steeply inclined part 30A of its undersurface 30; otherwise, it is of constant thickness, having parallel lower and upper faces 30B, 31. The acute-angled intersection 32 of the opposed faces of the security ring and the skirt is rounded, and forms part of the notional shoulder mentioned above.

Figure 4A:
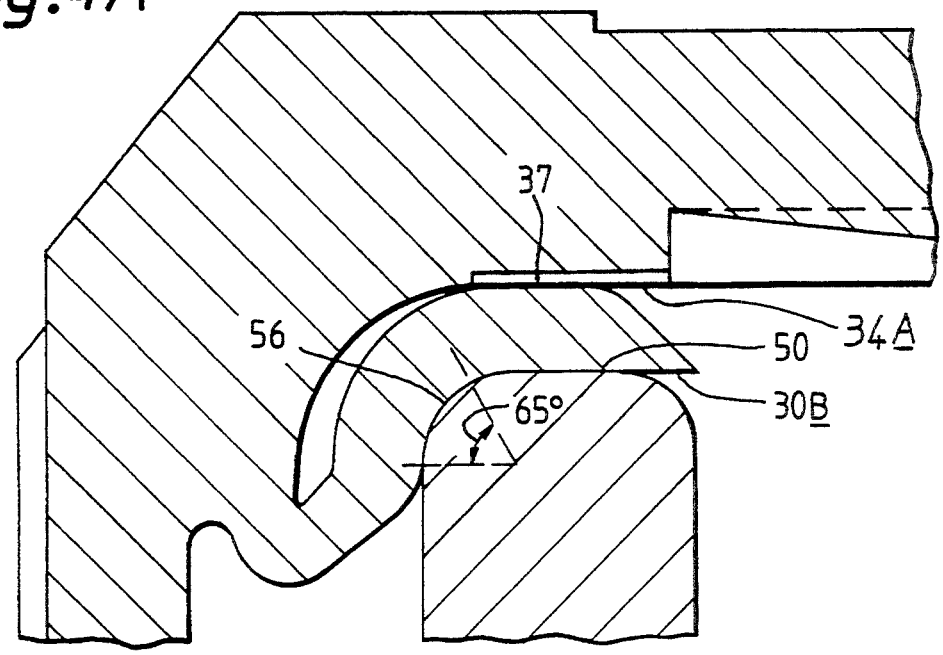
Figure 4B:
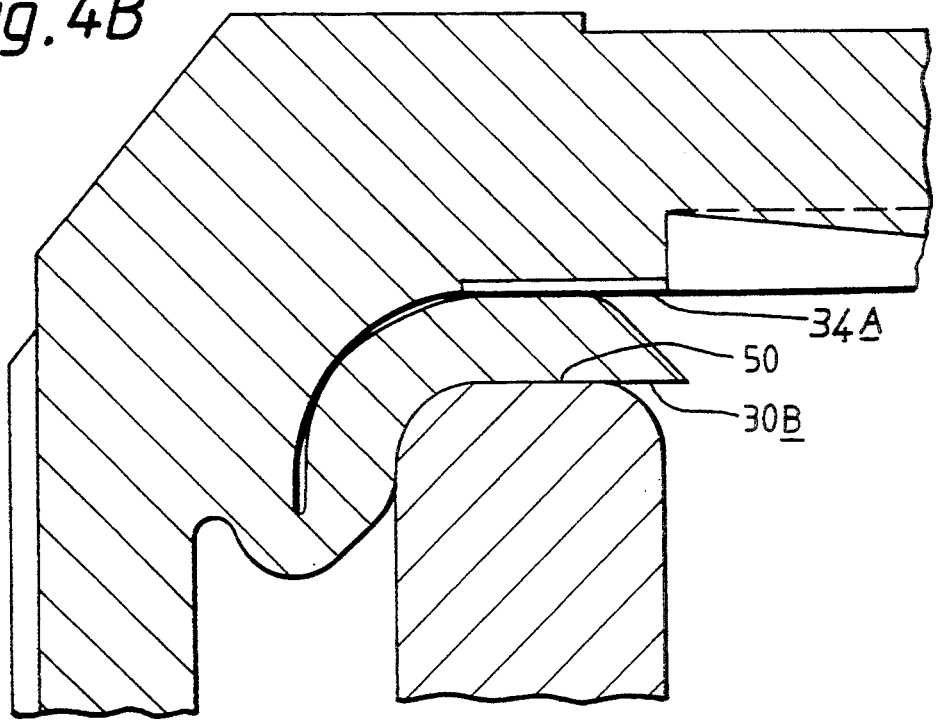

From FIG. 2 it will be understood that the periphery of the recess 17 is in approximate axial alignment with the bore 54 of the bottle neck 22. The interior surface 34 of the closure body 9 between the periphery of the recess and the root of the sealing ring 24 has a substantially plane annular inner part 34A where it is to overlie the plane top face 50 of the container rim, and a substantially part-circular outer part 34B where it is to lie generally in opposition to the arcuate outer peripheral surface 56 of the rim. The parts 34A, 34B merge seamlessly (i.e. without steps) so as to form a surface 34 which extends, substantially without interruption, between the recess and the root of the sealing ring around the whole periphery of the closure. In FIGS. 2, 4A and 4B the surface 34 is indicated by a heavy line for ease of identification.

As will become apparent, when the closure is in use the surface 34 serves to provide a mechanical abutment and pneumatic reaction surface. Also, it is required that the surface 34 should be incapable of making a gas-tight seal with the upper surface 31 of the sealing ring even where those two surfaces are forced mechanically into contact with one another. For that purpose the surface 34 is toughened, as is indicated diagrammatically by hollows 36 in FIG. 2.

Figure 3:
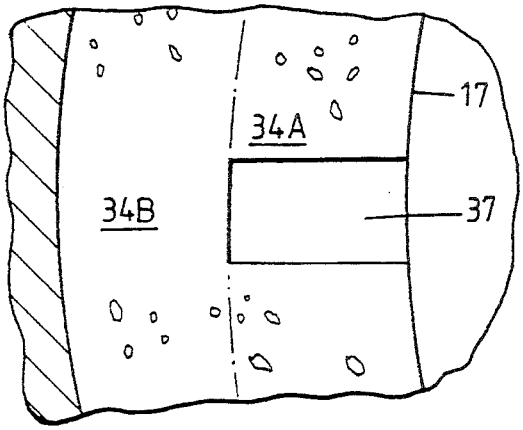
FIG. 3 shows a part of the closure interior, as seen in the direction of the arrow B of FIG. 2; and, FIGS. 4A and 4B show the closure when in its fitted position on the bottle neck, with respective limiting combinations of the closure and bottle neck dimensions.

As is shown particularly in FIG. 3 where the common boundary of the surface parts 34A, 34B is indicated by a broken line, seal prevention in addition to that provided by the roughening 36 is provided by a plurality of shallow, regularly spaced and radially extending grooves 37 which are formed in the plane part 34A of the surface 34.

It is preferred for the roughening 36 to have a range of roughnesses within the range 10 to 16 VDI, preferably about 13 VDI. Likewise, it is preferred for six grooves 37 to be provided, the circumferential width and axial depth of the grooves lying within the ranges 1 mm to 2 mm, and 0.10 mm to 0.16 mm, preferably about 1.5 mm and 0.13 mm respectively.

The closure is fitted to the bottle neck in the normal way, by rotary movement to effect screw-threaded engagement of the closure on the bottle neck. As shown in FIG. 2, the initial contact of the sealing ring 24 with the bottle neck 22 occurs somewhere on the top face 50 of the bottle, depending upon the relative dimensions of the bottle neck and the closure. Further axial movement of the closure on the bottle neck thereafter causes the sealing ring to be progressively flattened as its root moves down past the outer side face 52 of the container and its tip 29 simultaneously rides along the face 50 in the inward direction.

Eventually, the sealing ring becomes wrapped around the arcuate outer peripheral surface 56 of the container. As shown in FIGS. 4A and 4B, by the time that the closure has moved to its fitted position the sealing ring has become trapped between the closure body and the bottle neck, having been both inverted and deformed to a concave, generally arcuate shape conforming to the bottle neck contour. Also, some elongation of the sealing ring in the radial direction will have occurred. The stepless nature of the abutment and reaction surface 34 ensures that the movement of the sealing ring to its final, sealing position is unimpeded, and there is no risk that the sealing ring will become buckled or otherwise deformed in a way which is likely to impair its sealing efficiency.

FIG. 4A illustrates the situation which applies when a closure of which the dimensions are at the upper end of their permitted tolerance range has been fitted to a bottle neck having dimensions at the lower end of their range. From that Figure in particular it will be understood that the mechanical forces which are generated by the engagement of the bottle and closure threads when the fitted position of the closure has been reached are reacted, through the agency of the sealing ring, entirely or almost entirely by the plane annular surfaces 50, 34A of the bottle neck and closure body. The high pressures which are thereby created mechanically between the engaging surfaces 50, 30B of the bottle and the sealing ring provide an initial seal which is adequate to allow product pressure to build up in the bottle following capping.

For enabling it to contain the high gaseous pressures which may occur in the bottle particularly after standing unopened at elevated temperatures, the closure essentially relies on sealing engagement which occurs between the undersurface 30B of the sealing ring and the arcuate outer periphery 56 of the bottle rim. As indicated above, little or no mechanical pressure is available from the closure body 9 to generate sealing engagement at this locality, but gaseous pressure from the bottle is able, by virtue of the roughening 36 with the assistance of the grooves 37, to exert on the sealing ring an inward pressure by which the sealing ring is forced pneumatically and uniformly into sealing engagement with the surface 56 over a seal area which, as indicated, typically occupies 65° of included angle extending from the bottom of the surface 56.

Sealing may occur between the sealing ring and the top surface 50 of the bottle neck, but this seal is not required or relied upon except at low superatmospheric pressures as described above. It will thus be understood that after the closure has been applied and gaseous pressure increases within the bottle headspace, the effective seal provided by the closure moves outwardly from an original location at the top surface 50 of the bottle to a final location at the lower part of its arcuate surface 56. Therefore, at a time when sensitivity to top loading is potentially a problem, i.e. when a high pressure exists in the bottle, the effective seal interface is substantially axially directed, and sealing efficiency is therefore substantially insensitive to any variation in top loading on the closure which may occur.

Moreover, the radial freedom available for the part of the sealing ring lying opposite to the arcuate surface 56 of the container rim enables the sealing ring largely to accommodate itself to differing relative dimensions of the closure and container. FIG. 4B shows by way of illustration that contact may occur between the sealing ring and the surface 56 in the limiting combination of closure and container dimensions opposite to that shown in FIG. 4A (i.e. with an undersized closure on an oversized container neck), but it is to be understood that the roughening 36 ensures that product pressure will still be present behind the sealing ring to create a uniform sealing pressure with the surface 56 of the bottle neck.

If desired, by suitable dimensioning of the closure (in particular its sealing ring) in relation to the bottle, the seal interface may be extended downwardly onto the cylindrical outer side face 52 of the bottle neck, thereby further reducing the sensitivity of the closure to top loading.

In a modification of the closure described with reference to the drawings the grooves 37 are omitted and the roughening 36 is entirely relied upon to prevent the formation of a seal at the interface of the sealing ring 24 with the abutment and reaction surface 34 when the closure is fitted to the container. Furthermore, in another modification the upper surface 31 of the sealing ring is arranged to prevent seal-formation at the interface, preferably by the formation of roughening similar to the roughening 36.

Although a preferred embodiment of the invention has been specifically illustrated and described herein, it is to be understood that minor variations may be made in the apparatus without departing from the spirit and scope of the invention, as defined the appended claims.

I claim:

1. A one-piece closure for a pressurised product container having a mouth-defining rim with an arcuate outer periphery, the closure comprising a body having a generally plane closure panel and depending tubular skirt and providing a mechanical abutment and pneumatic reaction surface within its interior, and a flexible circumferential sealing formation attached integrally to the body and projecting radially inwardly of the closure tubular skirt to a free radially innermost edge, the closure being arranged, when fitted to the container, with said sealing formation positioned against the container rim and urged against the container rim by mechanical and pneumatic cooperation of the mechanical abutment and pneumatic reaction surface, seal-prevention means opening into an inner volume of said closure for preventing the mechanical abutment and pneumatic reaction surface from forming a seal by conducting product pressure between the mechanical abutment and pneumatic reaction surface and the sealing formation from the closure inner volume, and the mechanical abutment and pneumatic reaction surface extending substantially steplessly radially of the closure and in the fitted closure lying in opposition to the container rim including the arcuate outer periphery thereof with the sealing formation therebetween.

2. A closure as claimed in claim 1, characterised in that the seal-prevention means comprise roughening of the mechanical abutment and pneumatic reaction surface.

3. A closure as claimed in claim 2, characterised in that the roughening has a value lying within the range 10 to 16 VDI.

4. A closure as claimed in claim 1, characterised in that the seal-prevention means comprise grooves formed in the mechanical abutment and pneumatic reaction surface.

5. A closure as claimed in claim 4, characterised in that each groove extends substantially radially of the closure.

6. A closure as claimed in claim 2, characterised in that the seal-prevention means comprise the said roughening and a plurality of grooves in combination, and at least the roughening extending over substantially the whole of the abutment and reaction surface.

7. A closure as claimed in claim 1, characterised in that the sealing formation is of substantially constant thickness except at its attachment to the closure body where it is of reduced thickness.

8. A closure as claimed in claim 1, characterised in that the sealing formation is inclined inwardly of the closure and away from the closure panel, and is attached to the body at a shoulder which faces away from the closure panel.

9. A closure as claimed in claim 1, characterised in that the free edge of the sealing formation is formed as a feather edge at which the sealing formation may engage the container rim.

10. A container in combination with a one-piece plastics closure, the container having a mouth-defining rim with an arcuate outer periphery, and the closure comprising a body having a generally plane closure panel and a depending tubular skirt, and a flexible circumferential sealing formation attached integrally to the body and projecting radially inwardly of the closure towards a free edge in interposed relation between the container rim and a mechanical abutment and pneumatic reaction surface of the closure body interior, the sealing formation sealing against the container rim and being urged against the rim by mechanical and pneumatic cooperation with the mechanical abutment and pneumatic reaction surface, and seal prevention means opening into an inner volume of said closure for preventing the mechanical abutment and pneumatic reaction surface from forming a seal by conducting product pressure between the mechanical abutment and pneumatic reaction surface and the sealing formation, from the closure inner volume characterised in that the mechanical abutment and pneumatic reaction surface extends substantially steplessly in spaced opposition to the container rim including the arcuate outer periphery thereof.

11. A combination as claimed in claim 10, characterised in that the container rim has a plane annular surface from which the arcuate outer periphery extends, the mechanical abutment and pneumatic reaction surface correspondingly having a substantially plane portion and an arcuate portion, substantial mechanical contact between the mechanical abutment and pneumatic reaction surface and the sealing formation occurring only at the annular surface of the mechanical abutment and pneumatic reaction surface.

12. A plastics closure for a pressurised product container, which has a generally plane closure panel and a tubular skirt attached peripherally to the closure panel at an arcuate junction, the skirt being internally formed with a formation for engagement with a complementary formation of a said container to attach the closure releasably to the container, the closure furthermore having a flexible circumferential sealing formation integrally attached adjacent the arcuate junction thereof, the sealing formation projecting radially to a free edge continuously around the closure and generally at an inclination to both the closure panel and the skirt, an internal surface of the closure adjacent and surrounded by the sealing formation extending steplessly across the arcuate junction and an adjacent annular marginal region of the closure panel, and seal-prevention means being provided for preventing the formation of a seal at the interface of the sealing formation with the internal surface on mutual engagement thereof when the closure is applied to a container.

13. A closure according to claim 12, wherein the seal-prevention means comprises roughening of the internal surface.

14. A closure according to claim 13, wherein the roughening has a roughness lying within the range 10 to 16 VDl.

15. A closure as claimed in claim 3, characterised in that the seal-prevention means comprise the said roughening and a plurality of grooves in combination, and at least the roughening extending over substantially the whole of the abutment and reaction surface.

16. A closure as claimed in claim 1 characterised in that the sealing formation is inclined inwardly of the closure.

17. A closure as claimed in claim 1 characterised in that the sealing formation is inclined inwardly of the closure and away from the closure panel.

* * * * *